United States Patent [19]

Kramer et al.

[11] Patent Number: 4,785,325

[45] Date of Patent: Nov. 15, 1988

[54] ADJUSTABLE SPEED CONTROL FOR A DOCUMENT IMAGING SYSTEM

[75] Inventors: William E. Kramer, Fairport; John E. Forward, Penfield, both of N.Y.

[73] Assignee: Xerox Corporation, Stamford, Conn.

[21] Appl. No.: 120,908

[22] Filed: Nov. 16, 1987

[51] Int. Cl.[4] ..... G03G 15/00

[52] U.S. Cl. ..... 355/8; 355/3 SH; 355/14 SH; 355/48; 355/50

[58] Field of Search ..... 355/8, 3 SH, 14 SH, 355/14 R, 48, 50, 49, 51

[56] References Cited

U.S. PATENT DOCUMENTS

| | | | |
|---|---|---|---|
| 1,092,098 | 3/1914 | Fitzgerald . | |
| 1,374,439 | 4/1921 | Doherty | 64/8 |
| 2,552,179 | 5/1951 | Kamp | 74/230.21 |
| 3,604,281 | 9/1971 | Shambaugh | 74/230.5 |
| 4,000,943 | 1/1977 | Bar-on | 355/8 |
| 4,110,028 | 8/1978 | Schneider | 355/8 |
| 4,214,832 | 7/1980 | Kono et al. | 355/8 |
| 4,217,052 | 8/1980 | Tani et al. | 355/14 R |
| 4,319,835 | 3/1982 | Navone | 355/50 |
| 4,407,581 | 10/1983 | Shogren et al. | 355/8 |
| 4,487,518 | 12/1984 | Enrini | 400/320 |
| 4,504,022 | 3/1985 | Stang | 242/47.01 |
| 4,607,943 | 8/1986 | Yoshioka | 355/8 X |

*Primary Examiner*—R. L. Moses

[57] ABSTRACT

A document imaging system incorporates a mechanism for adjusting the speed ratio between the document scanning system and the photoreceptor. A timing belt is connected between an adjustable tapered portion of a drive pulley mounted on the photoreceptor drive shaft and the document scanning system. The portion of the tapered surface on which the belt is frictionally is axially adjustable resulting in a change in the effective diameter of the belt and a change in the scanning speed.

5 Claims, 4 Drawing Sheets

ADJUSTABLE SPEED CONTROL FOR A DOCUMENT IMAGING SYSTEM

BACKGROUND AND PRIOR ART STATEMENT

This invention relates to a scanning type document imaging system and, more particularly, to a mechanism for adjusting the scanning speed to compensate for speed variations between scan and photoreceptor.

In the photocopier art, documents are reproduced onto a photoconductive imaging member at varying magnification ratios, the most common being a 1:1 magnification. At this 1X reproduction rate in a sanning type of optical system where a document in an object plane is incrementally illuminated and scanned and a flowing image projected upon a moving photoreceptor, the scanning speed must be exactly matched to the speed of the photoreceptor as it moves through the image plane. Any mismatch between the speeds results in a variation in the magnification ratio and/or a blurring of the output copy. As is known in the art, the scanning function can be enabled by movement of a document platen, or of the document alone, past a stationary exposure zone; alternatively, the document may be stationary and scanning optics, including a lamp-/mirror combination, moved in a scan mode along the length of the document. Imaging systems are subject, with continued operation, to various changes in operating parameters which affect the original set of speed relationships. Typically, compensation is achieved by using variable speed drive systems which include servo motors to change the speed at which a document is scanned. A variable drive system encompasses a controller feedback circuit and a stepper or servo motor to adjust the relative speeds of the photoreceptor or the scanning mechanism either individually or in some combination. This type of prior art control system is relatively expensive because of the added cost of the controller and motors.

The following disclosures appear to be relevant:

U.S. Pat. No. 1,092,098 to Fitzgerald discloses a pulley whose diameter is varied by a rim movable supported over the diameter of a central hub.

U.S. Pat. No. 1,374,439 to Doherty discloses a device for increasing or decreasing the speed of a machine by shifting or changing the driving diameter of a belt pulley. A conical member is movable along a shaft 10 so as to change the working diameter of the pulley.

U.S. Pat. No. 2,552,179 to Kamp discloses a variable speed pulley which includes axially slideable mounted cones 5.

U.S. Pat. No. 3,604,281 discloses a variable speed device in which a belt support includes an elongated strip whose diameter is made variable.

U.S. Pat. No. 4,504,022 discloses an expandable feed roller comprising two discs, one of which is moveable axially along a shaft to change the effective diameter.

U.S. Pat. No. 4,487,518 to Enrini discloses an adjustable diameter pulley in which a plastic ring is elastically expandable about a tapered core assembly. The expansion is made variable by an engagement with a threaded nut which is located at the smaller end of the core assembly.

The present invention is directed to a more economical and simpler mechanism of adjusting speed ratios in a document scanning system. A mechanical control system is disclosed which is relatively inexpensive and which enables an operator to compensate for speed variations as they occur. The invention is more particularly directed towards a document imaging system, comprising, in combination, means for moving a document across an exposure zone formed in an object scanning plane, means for projecting a flowing light image of the document onto the surface of a photoreceptor moving at the same speed as the document, an adjustable pulley speed mechanism connected to the moving photoreceptor and adapted to be driven at the same rotational speed, a timing belt frictionally entrained between said pulley mechanism and said document moving means and means for changing the effective diameter of said pulley mechanism so as to effect a change in the speed of the document movement across the exposure zone.

DESCRIPTION OF THE INVENTION

Figure 1:
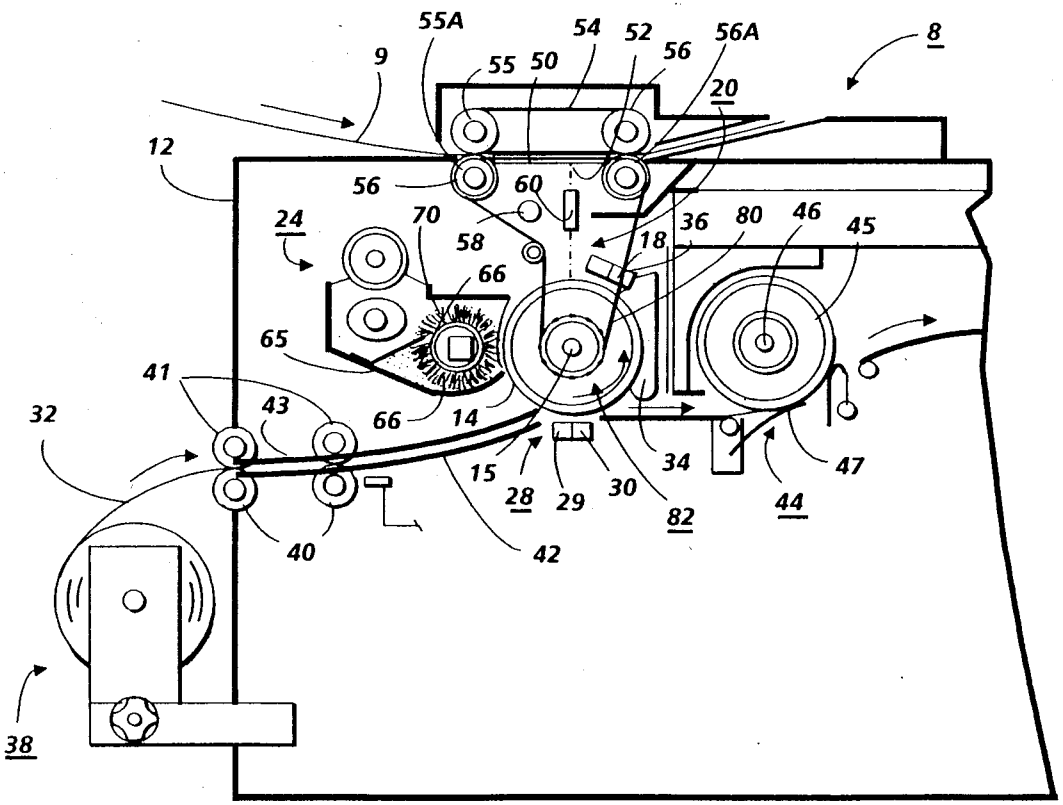
FIG. 1 is a schematic drawing of a document copier in which the present invention is used.
Figure 2:
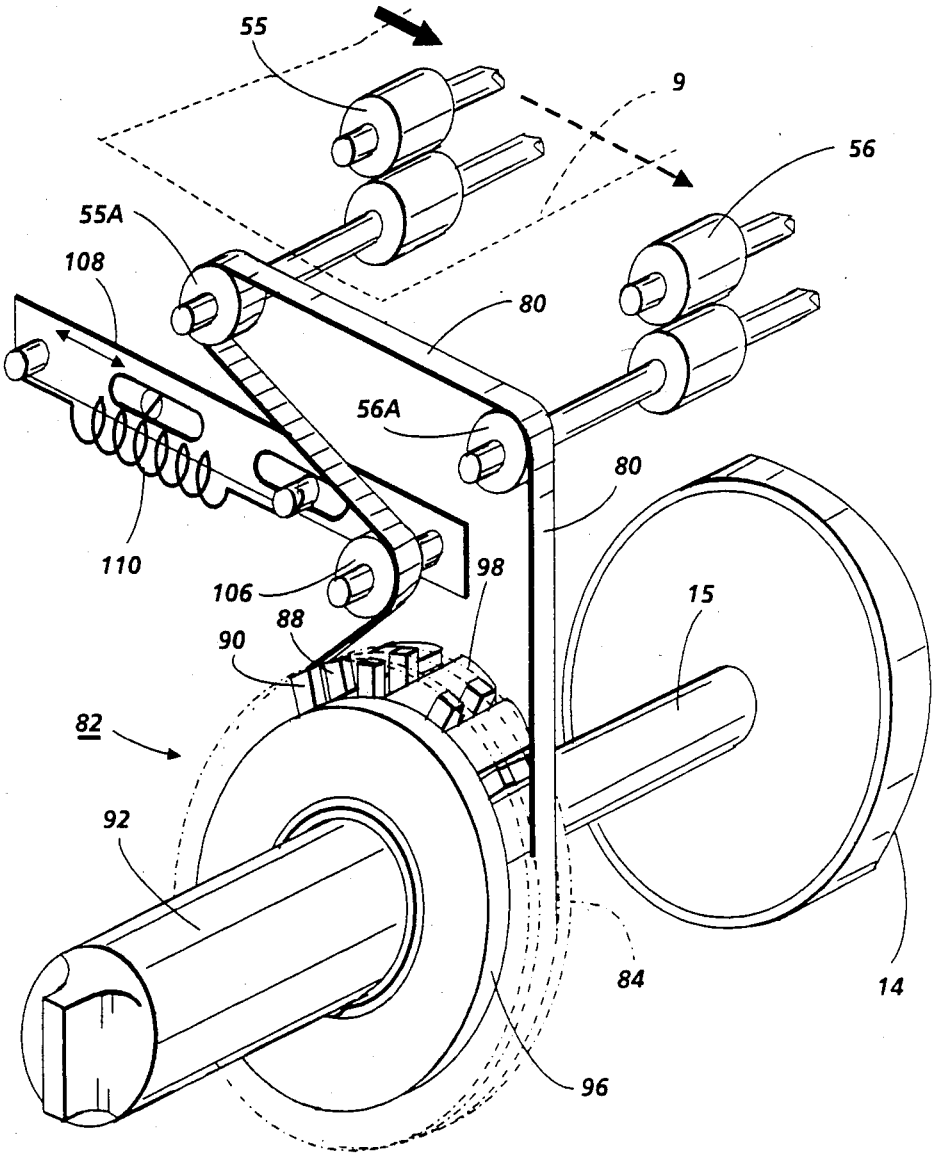
FIG. 2 is a perspective view of the sanning speed mechanism of the present invention showing particularly an adjustable speed pulley operatively connected between the photoreceptor and the document drive.
Figure 3:
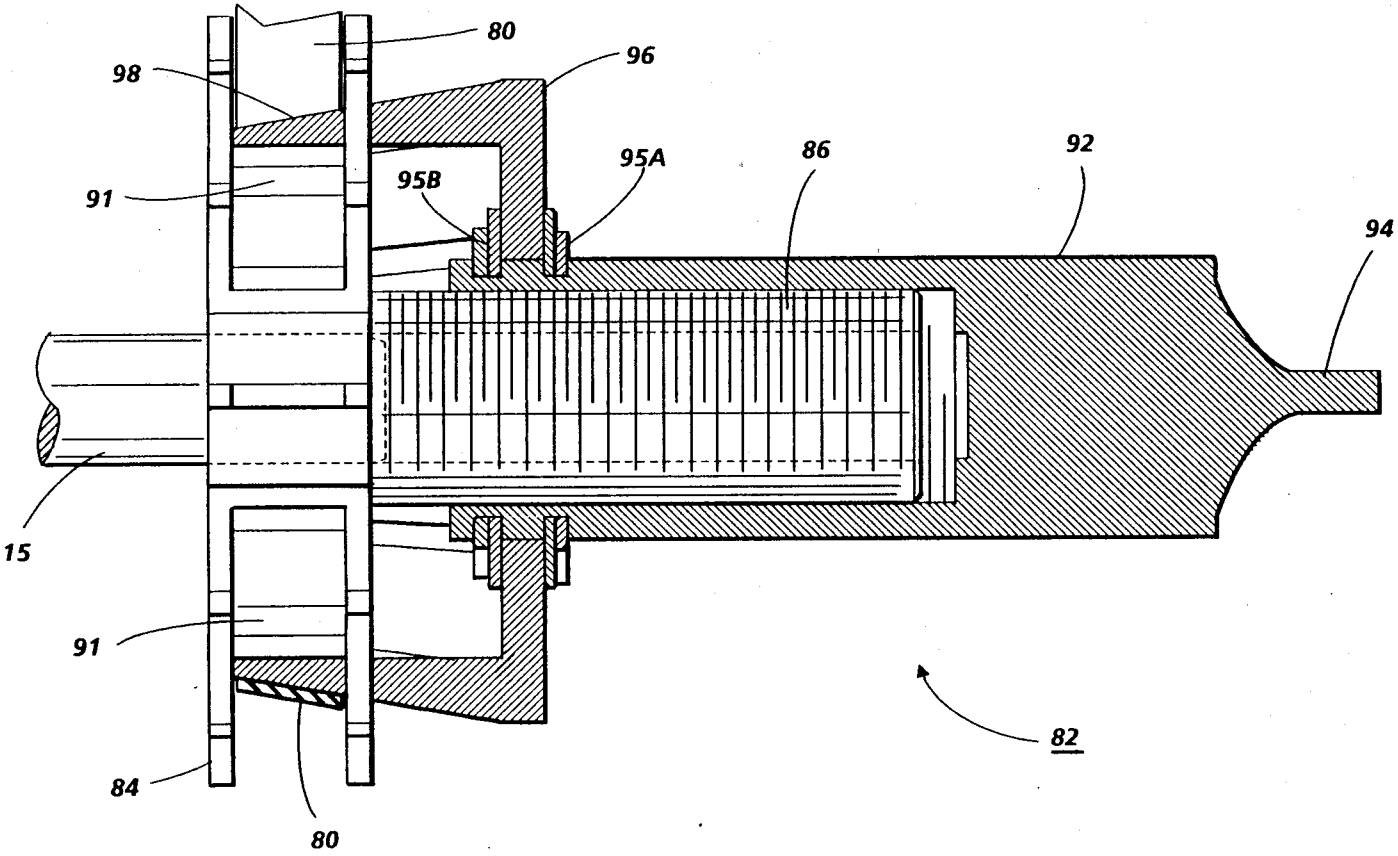
FIG. 3 is a side internal view of the adjustable speed pulley shown in FIG. 2.
Figure 4:
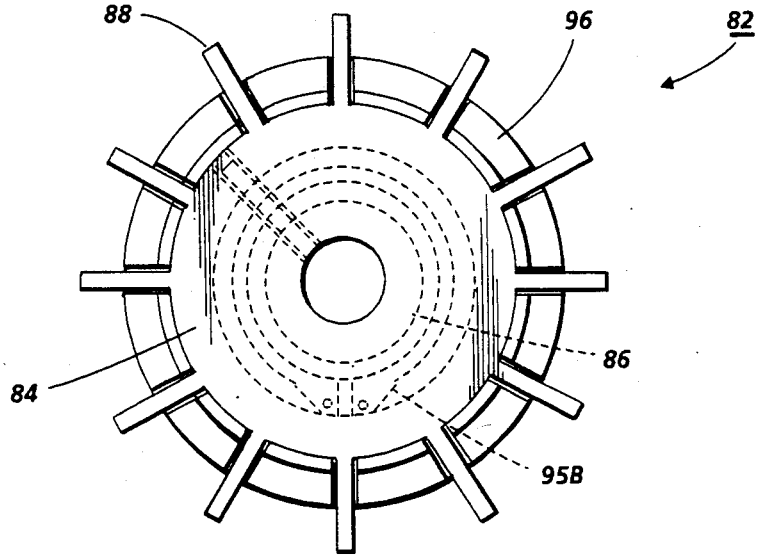
FIG. 4 is an end view of the adjustable speed pulley of FIG. 2.
Figure 5:
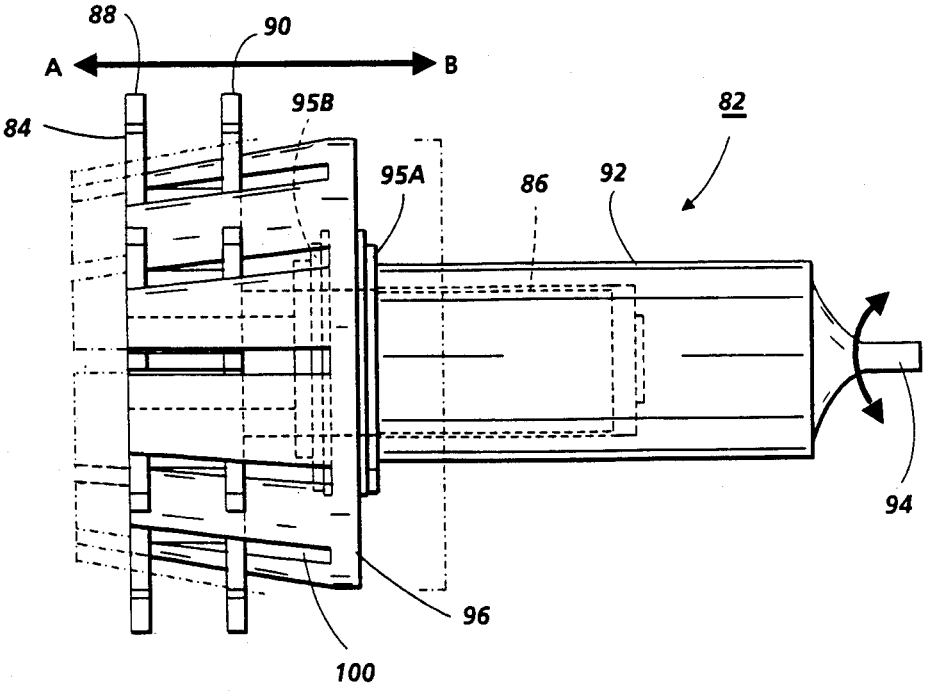
FIG. 5 is a side-view of the adjustable speed pulley showing the axial movement of the adjustable mechanism.

Referring to FIG. 1 of the drawings, there is shown a xerographic type reproduction machine 8 incorporating the present invention. Machine 8 has a suitable frame 12 on which the machine xerographic components are operatively supported. Briefly, and as will be familiar to those skilled in the art, the machine xerographic components include a recording member, shown here in the form of a rotatable drum 14, mounted on drive shaft 15. Drive shaft 15 is driven by a motor (not shown) which drives the shaft at the desired process speed. Other types of photoreceptors, such as a belt or web, may also be used. Operatively disposed around the periphery of the drum is a charge corotron 18 for placing a uniform charge on the surface of the drum, an exposure station 20 where the previously charged photoconductive surface of drum 14 is exposed to image rays of a document 9 being scanned; development station 24 where the latent electrostatic image created on the photoconductive surface is developed by toner; transfer station 28 with transfer corotrons 29, 30 for transferring the developed images to copy media 32 brought forward in timed relation with the developed image on the photoreceptor surface, and cleaning station 34 for removing leftover developer. Copy media 32 is fed from a media roll support assembly 38, and is brought forward by feed roller pairs 40,41 and fed between sheet guides 42,43. Following transfer, the media 32 is carried forward to a fusing station 44 where the toner image is fixed by fusing roll 45 in cooperation with a biased flexible web 47. Fusing roll 45 is heated by a suitable heater such as lamp 46 disposed within the interior of roll 45. After fixing, the media 32 is conveyed to a seperate output station (not shown) where the media is cut into appropriate sized image frames and, if desired, rolled into cylindrical form for easier handling.

Continuing with the description of machine 8, transparent platen 50 supports the document 9 as the document is moved past a scan point 52 by a constant velocity transport 54. As will be understood, scan point 52 is, in effect, a scan line extending across the width of platen 50 at a desired point where the document is scanned line-by-line. Transport 54 has input and output document feed roll pairs 55, 56, respectively, on each side of scan point 52 for moving a document 9 across platen 50 at a predetermined speed. Rollers 55, 56 are mounted on shafts 55A, 56A. Exposure lamp 58 is provided to illuminate a strip-like area of platen 50 at scan point 52. The image rays from the document line scanned are transmitted by a gradient index lens array 60 to exposure station 20 to expose the photoconductive surface of the moving drum photoreceptor 14.

Developing station 24 includes a developer housing 65, the lower part of which forms a sump 66 for holding a quantity of developer. A rotatable magnetic brush developer roll 70 is disposed in predetermined operative relation to the photoconductive surface. In developer housing 65, roll 70 serves to bring developer from sump 66 into developing relation with drum 14 to develop the latent images formed on the surface thereof.

As will be described in further detail below, a timing belt 80 is entrained along an adjustable speed pulley 82 and the document feed roller shafts 55A, 56A.

In the preferred embodiments, document 9 represents a large (36 inch) engineering drawing. The width of the photoreceptor and the dimensions of the developer, transfer, cleaning, fusing and media roll support assembly are of like dimensions.

Referring now to FIGS. 2 through 5, adjustable speed pulley mechanism 82 comprises a drive pulley 84 having a shaft 86 fixedly mounted to drive shaft 15 and thereby adapted to rotate at the same speed (process speed) as shaft 15. Pulley 84 has arranged, along its circumference, a plurality of pairs of complementary tooth segments 88, 90, each tooth pair connected at the base by ridge 91. An adjustable shaft member 92, having an internally threaded portion, is secured to shaft 86 and can be advanced axially along the threaded portion of shaft 86 by turning knob 94 at the outboard end of shaft 92. Mounted towards the inboard side of shaft 92 is cylindrical, tapered slotted member 96. Member 96 is held in place by metal snap rings 95A,96B which are seated in grooves formed in shaft 92. Member 96 has a plurality of blunt-ended, finger-like, tapered tabs 98 separated by rectangular-shaped slots 100. The tab dimensions are such that they can fit within the spaces between the tooth segment pairs 88, 90. Slots 100 are slightly wider than the tooth segment widths. The ends of tabs 98 rest on some portion of the inter-tooth pair surface, the exact location dependent on the axial position of adjustable shaft member 92.

Clockwise rotation of knob 94 moves shaft member 92, and hence tabs 98, towards the photoreceptor; counterclockwise rotation has the opposite effect. As will be evident from FIG. 5, movement of member 92 causes the tabs 98 to move in and out between the rows of segments 88, 90 changing the location of the tapered surface of the tabs. This movement has the effect of changing the diameter of pulley 84. The effective diameter increases when the tapered fingers are moved in direction A and decreases when the fingers are moved in opposite directions.

Continuing with the description, timing belt 80 has a plurality of ridges (teeth) on the entraining surface. Belt 80 is entrained about drive shafts 55A, 56A, which preferably have complementary grooved surfaces. The belt is entrained about, and driven by, drive pulley 84. The belt is frictionally entrained against the tapered surface of tabs 98 with its lateral movement limited by the sides of segments 88, 90. Belt 80 is also entrained about idler pulley 106 attached to bracket 108 and loaded against spring 110, this arrangement compensating for belt path length changes.

In operation, the position of shaft member 92 is initially adjusted so that the timing belt 80 drives the document feed rollers 55, 56 to move the document through the exposure zone at the same speed as the drum rotation (process speed). With continued operation, some misalignment between the two speeds may occur due to tolerances of component parts or media variations. This change is manifested to an operator by slight changes in magnification of the output copy. The relative speeds can be adjusted by the operator turning knob 94 moving shaft 92, and hence tabs 98, axially in direction A or B. This adjustment varies the position of the tapered portion of the tabs, effectively increasing or decreasing the diameter of pulley 84 depending upon the direction of the adjustment. If the output copy shows a slight reduction in magnification, the scanning speed must be decreased. The operator will therefore make a counterclockwise adjustment to effectively decrease the pulley diameter causing the belt to ride lower on the hub thereby effectively decreasing the scanning speed. Similarly, a slight enlargement noted in the output copy can be adjusted by turning nut 102 clockwise to increase pulley diameter and increase the scanning speed. The exact adjustment required will thus be dependent upon the operator's perception of the quality of the output copy.

According to another aspect of the invention, if belt wear through frictional engagement becomes a problem, a flexible member such as a silicon rubber O ring could be inserted between the belt and the pulley drive surface.

While the invention has been described with reference to the structure disclosed, it is not confined to the specific details set forth, but is intended to cover such modifications or changes as may come within the scope of the following claims:

What is claimed is:

1. In a document imaging system, in combination, means for moving a document across an exposure zone formed in an object scanning plane, means for projecting a flowing light image of the document onto the surface of a photoreceptor moving at the same speed as the document, an adjustable pulley speed mechanism connected to the moving photoreceptor and adapted to be driven at the same rotational speed, a timing belt frictionally entrained between said pulley mechanism and said document moving means and means for changing the effective diameter of said pulley mechanism so as to effect a change in the speed of the document movement across the exposure zone.

2. The imaging system of claim 1 wherein said pulley mechanism includes a drive pulley mounted on a first shaft driven at the same rotational speed as the photoreceptor, the drive pulley having along its circumference a plurality of complementary tooth segments, said pulley mechanism further including a second shaft which is axially moveable along said first shaft and a slotted cylindrical member mounted on said second shaft and adapted for axial movement therewith, said slotted member having a plurality of tapered, finger-like tabs which are adapted to move axially in the spaces between said tooth segment pairs coincident with the movement of said second shaft thereby changing the effective diameter of the drive pulley.

3. The imaging system of claim 2 wherein said document moving means comprises a plurality of document feed rollers mounted on rotatable shafts and wherein said drive belt is entrained about said feed roller shafts and between the tooth segments of said drive pulley, the engaging portion of the belt determined by the position of the tapered surface of said tabs.

4. The imaging system of claim 3 further including a spring-loaded idler system to compensate for belt length path changes.

5. The imaging system of claim 3 further including a flexible member inserted between the belt and the drive pulley.

* * * * *